United States Patent [19]

Santi

[11] 4,188,930

[45] Feb. 19, 1980

[54] BREAKERLESS FLYWHEEL MAGNETO IGNITION SYSTEM

[75] Inventor: John D. Santi, Milwaukee, Wis.

[73] Assignee: Briggs & Stratton Corporation, Milwaukee, Wis.

[21] Appl. No.: 929,855

[22] Filed: Jul. 31, 1978

[51] Int. Cl.[2] ..... F02P 1/00

[52] U.S. Cl. ..... 123/148 E; 315/209 T

[58] Field of Search ..... 123/148 E, 148 CC; 315/209 T, 209 SC; 310/70, 70 R

[56] References Cited

U.S. PATENT DOCUMENTS 3,484,677 12/1969 Piteo ..... 123/148 E

*Primary Examiner*—Ronald B. Cox

*Attorney, Agent, or Firm*—E. Eugene Kohls

[57] ABSTRACT

In a flywheel magneto ignition system, opposite terminals of the primary winding are respectively connected with the collector and emitter terminals of a transistor device. A biasing coil, inductively coupled with the magneto armature core, has its terminals respectively connected to the transistor base and emitter terminals to bias the transistor on during an interval terminating at the time of ignition. An SCR, non-conductive during said interval, is connected for short circuiting the biasing coil. A trigger coil, connected with the SCR gate through a zener diode, provides gating current for the SCR at the time of ignition. A diode in series with the biasing coil and the base-emitter junction of the transistor ensures fast transistor turn-off.

9 Claims, 4 Drawing Figures

Fig. 2.
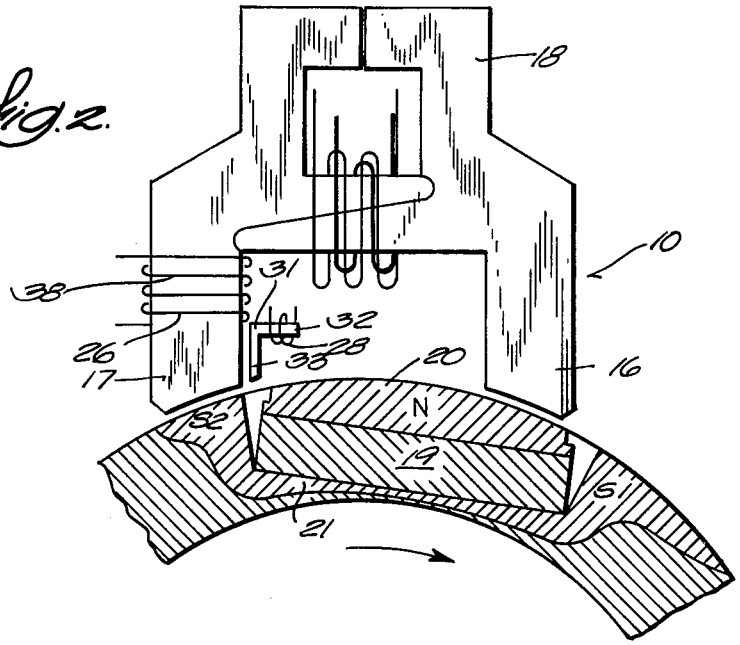
Fig. 3
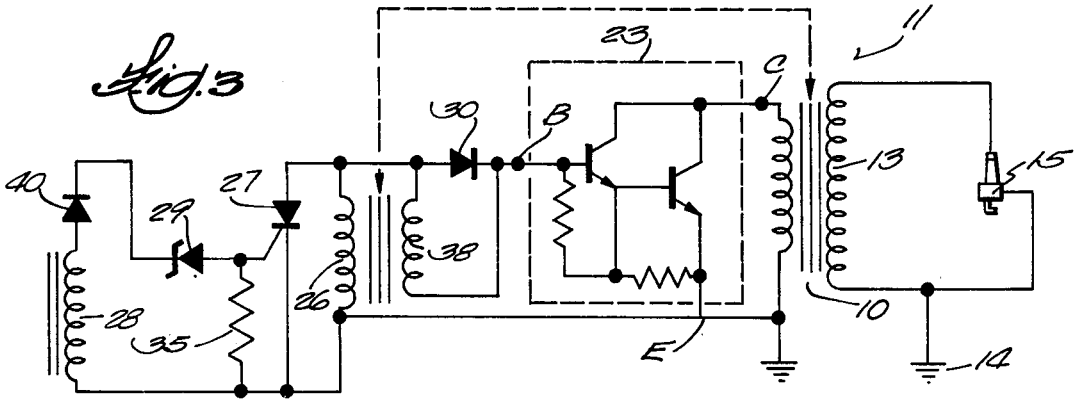
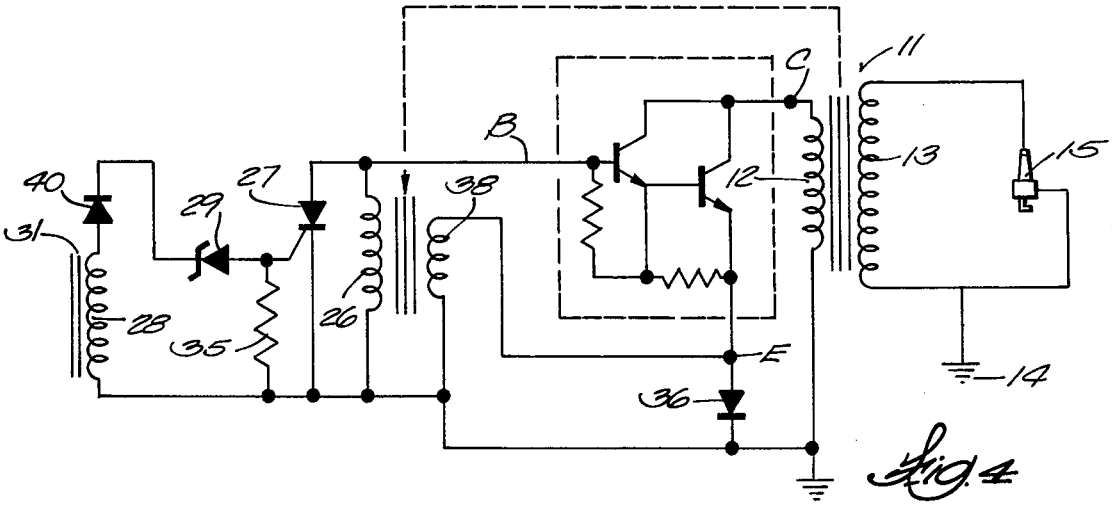
Fig. 4

BREAKERLESS FLYWHEEL MAGNETO IGNITION SYSTEM

This invention relates to breakerless magneto ignition systems for cyclically operating internal combustion engines; and the invention is more particularly concerned with a flywheel magneto ignition system wherein switching of the primary winding circuit is controlled by transistor means.

A magneto ignition system for an internal combustion engine comprises a permanent magnet that is carried on a rotating part of the engine for orbital motion in timed relation to the engine cycle, a primary winding and a secondary winding that are inductively coupled with a relatively stationary core mounted adjacent to the magnet orbit, and switching means connected in a circuit with the primary winding.

Through an interval in each engine cycle that terminates at the time when an ignition spark is required, the orbitally moving magnet charges into the core a rapidly changing flux that is linked with the primary winding and induces an e.m.f. in it. During that interval, the circuit comprising the primary winding is maintained closed by the switching means, so that a strong current flows in the core while the magnet moves into a portion of its orbit in which it tends to charge into the core a flux of opposite polarity. At the instant the spark is to be produced, the switching means effects opening of the circuit comprising the primary winding, thus terminating flow of current in the primary. The flux field that the primary current had tended to maintain in the core thereupon collapses abruptly, giving way to the magnet-charged flux of opposite polarity. The abruptly reversing flux in the core, being linked with the secondary winding, induces a high voltage across the secondary and thus causes a spark to jump across the gap of a spark plug that is connected with the terminals of the secondary.

Conventionally, the switching means in a magneto ignition system has comprised a pair of hard metal breaker points that were actuated to and from engagement with one another by mechanism comprising a cam that rotated in timed relation to the engine cycle. The rotating and rubbing parts in the breaker point actuating mechanism were subject to wear, but if carefully designed and manufactured they could ordinarily last for the life of the engine. The points themselves, however, had a limited service life due to the mechanical shock of their rapid percussive engagements and to their electrical erosion as a result of incipient arcing that tended to occur between them as they separated. It was therefore well known that replacement of breaker points at more or less regular intervals was essential for dependable engine operation.

On a small engine, such as the engines commonly used for powering lawn mowers, garden tractors and the like, replacement of the breaker points ordinarily had to be accomplished by skilled service personnel equipped with special tools, because the engine flywheel had to be removed for access to the breaker points and the newly installed points had to be carefully and skillfully adjusted.

The heretofore conventional breaker point mechanism required that a condenser be connected across the breaker points to minimize arcing between them. If the condenser failed, it short-circuited the points and the engine would not run. Although infrequent, condenser failure occurred often enough that many mechanics recommended replacing the condenser when points were changed.

Thus the conventional breaker point mechanism, although reasonably low in first cost, was actually rather expensive for the engine owner because of the inevitable need for one or more costly breaker point replacements during the life of the engine. And because it was subject to failure, it detracted from the overall reliability of the engine.

It is understandable, therefore, that there has been a long-standing desire to replace the conventional mechanical breaker point switching apparatus with electronic switching means comprising solid state devices. In the early stages of solid state development there may have been some difficulty in finding a solid state device capable of carrying the rather large currents in a magneto primary circuit, but for a good many years now transistors and transistor devices that can easily handle such currents have been readily available and rather inexpensive. The heretofore unsolved problem has been that of causing a transistor or a transistor device to perform switching operations in properly timed relation to the engine cycle.

Biasing a transistor on during the interval which terminates at the instant of ignition has not posed a difficult problem, especially since the time of commencement of that interval is not particularly critical so long as the primary circuit is effectively closed through most of the time that magnet-charged flux in the armature core is tending to undergo reversal and remains closed up to the instant at which the spark is to occur. But turn-off of the transistor must take place abruptly and completely and must occur in very accurately timed relation to the engine cycle. Heretofore it has not been known how to effect such turn-off with proper timing at all engine speeds. If engine speed is to be permitted to have any effect upon the time of turn-off, turn-off should occur somewhat later in the cycle at low engine speeds than at high engine speeds, to provide a measure of automatic spark advance. However, fixed spark timing has been widely used on small engines equipped with breaker point systems and is therefore satisfactory in a breakerless ignition system for such engines.

The need for effecting turn-off of a transistor consistently at a predetermined time in the engine cycle has called forth a number of proposals for hybrid systems, in each of which mechanical breaker points were employed for timing purposes and were connected with a solid state device that handled most of the power in the primary circuit. As examples of such proposed arrangements, see U.S. Pat. No. 2,878,298 to Giacoletto, U.S. Pat. No. 3,291,109 to Neopolitakis, U.S. Pat. No. 3,363,142 to Ford, U.S. Pat. No. 3,375,812 to Koda, and U.S. Pat. No. 3,952,717 to Goto et al. Such hybrid apparatus was intended to minimize electrical erosion of the breaker points, and it thus offered a possible increase in breaker point life, but it was more expensive and complex than a simple breaker point mechanism and did not eliminate the breaker points themselves.

The problem of accurately timed turn-off of a solid state device has been more or less circumvented in capacitor discharge ignition systems, in which a solid state device—typically an SCR—is triggered on at the time a spark is to be produced. In such a system, a capacitor, connected in series with the SCR and a primary winding, is charged during a portion of the engine cycle that precedes the sparking impulse, while the SCR remains non-conducting. The SCR is triggered on by means of a small trigger coil that cooperates with an orbitally moving magnet, whereupon the capacitor discharges itself rapidly through the primary, to thus induce a high voltage in a secondary winding. Because of limitations inherent in the rate of discharge of a condenser, the spark produced by a capacitor discharge system is not favorable for engine starting in severely cold weather.

A few breakerless magneto ignition systems of other than the capacitor discharge type have been proposed, but heretofore none of them has met the stringent requirements for low cost, simplicity and near-perfect dependability that are mandatory in small engine equipment. One of the few prior patents that discloses breakerless switching apparatus intended for flywheel magneto ignition systems of the type used on small engines is U.S. Pat. No. 3,405,347. The several circuits disclosed in that patent appear to be relatively simple, but the magneto rotor requires a special magnet arrangement and therefore the apparatus tends to be expensive because it cannot be used with a conventional engine flywheel intended for a mechanical breaker point system. Furthermore, those of the circuits described in that patent that seem to promise a reasonable probability of suitable and consistent spark timing are likely to produce a low energy spark that would be undesirable for cold weather starting conditions unless they were used with an especially adapted ignition coil that would be relatively expensive.

From what has been said above, it will be evident that breakerless switching apparatus for small engine ignition systems must satisfy a set of very demanding requirements. The cost can be slightly higher than a breaker point system, because most engine purchasers can appreciate the advantages of never having to replace breaker points; but competition in the small engine industry is so intense that anything more than a small cost premium will result in sales resistance. Spark timing with a breakerless system must be consistent not only at starting and normal running speeds but throughout the speed range of the engine. The spark produced by the apparatus must be comparable in energy and duration to the spark obtained with mechanical breaker point apparatus, to ensure good cold weather starting characteristics. And of course the breakerless apparatus must be capable of surviving a substantial amount of abuse in view of the fact that the machines commonly powered by small engines—e.g. lawn mowers, snow blowers and rotary soil tillers—are operated in very unfavorable environments.

In addition, however, consideration must be given to variations in performance parameters as between supposedly identical solid state devices. A breakerless switching device must be capable of affording precisely the desired spark timing and optimum spark output with every one of its components at either limit of its acceptable range of performance characteristic tolerances, or anywhere in between, and without the need for individual adjustment of each assembly.

With all of these considerations in mind, it is the general object of the present invention to provide breakerless switching apparatus for magneto ignition systems, and particularly for the flywheel magneto systems that are common on small engines, which apparatus meets all of the above-stated requirements to the highest degree.

Another and more specific object of the invention is to provide breakerless switching means for a magneto ignition apparatus of the character described wherein a readily available and inexpensive transistor or monolithic Darlington transistor device has its collector and emitter terminals respectively connected with the terminals of the magneto primary winding, to provide for opening and closing of the primary circuit; wherein a biasing coil cooperates with the magneto magnet and core to provide a source of biasing current whereby the transistor is maintained conductive during an interval that terminates at the time when a spark is to be produced; and wherein a trigger coil, cooperating with the magneto magnet, triggers a controlled rectifier into conductivity at the time the spark is to be produced, and triggering of the controlled rectifier in turn causes abrupt turn-off of the transistor, to terminate current flow in the primary winding.

Another specific object of the invention is to provide a breakerless magneto ignition system of the character described that incorporates most of the components of a conventional breaker point magneto system, for maximum production economy.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of embodiments of the invention constructed according to the best modes so far devised for the practical application of the principles thereof, and in which:

FIG. 1 is a view partly in elevation and partly in section of a single cylinder engine equipped with a flywheel magneto ignition system having breakerless switching means embodying the principles of this invention;

FIG. 3 is a circuit diagram of a breakerless magneto ignition system embodying the princples of the present invention; and FIG. 4 is a circuit diagram generally similar to FIG. 3 but illustrating a modified embodiment of the invention.

Figure 2:
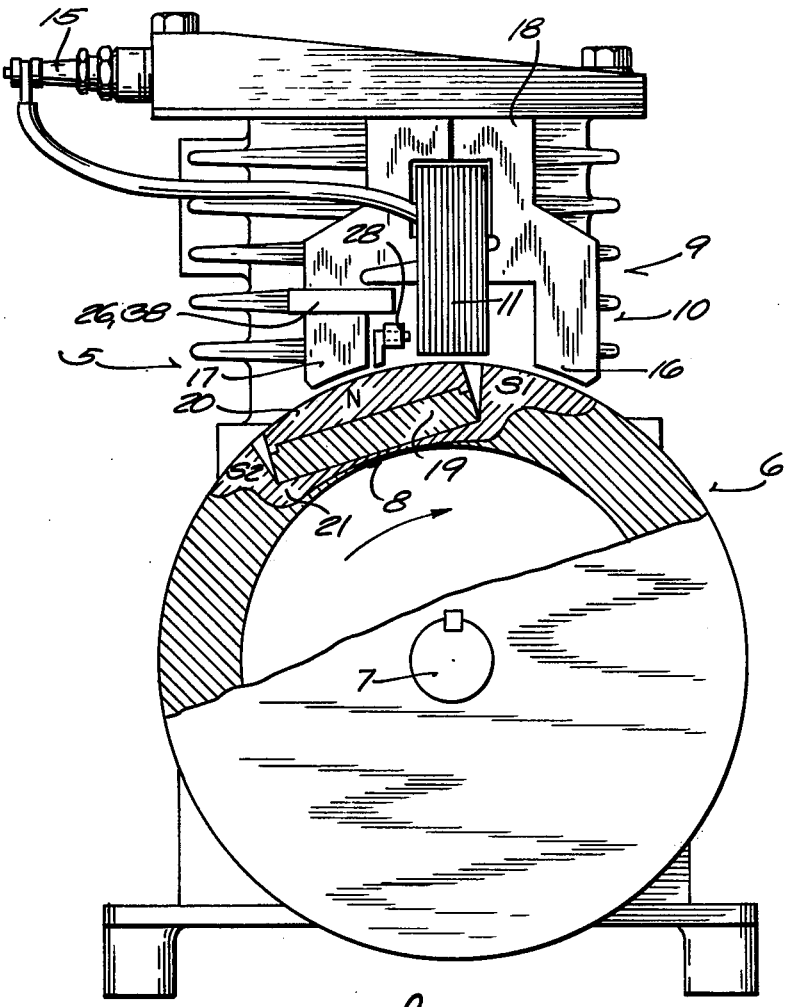
FIG. 2 is a more less diagrammatic view of the magneto ignition apparatus shown in FIG. 1.

Referring now to the accompanying drawings, the numeral 5 designates the body of a single cylinder gasoline engine that has a flywheel 6 secured on its crankshaft 7 to rotate therewith and thus impart orbital motion to a permanent magnet assembly 8 carried in the rim of the flywheel. Mounted on the engine body, outwardly adjacent to the flywheel periphery, is a magneto armature 9 which cooperates with the magnet assembly 8 and which comprises a core 10 of ferro-magnetic material and an induction coil 11 that surrounds a portion of the core. As is conventional, the induction coil 11 comprises a primary winding 12, consisting of a relatively few turns of a relatively heavy wire, and a secondary winding 13 that consists of many more turns of finer wire. One terminal of each of the primary and secondary windings is grounded, as indicated at 14, and a spark plug 15 is connected across the terminals of the secondary winding.

The illustrated magneto armature 9 embodies the teachings of U.S. Pat. No. 3,114,851, to J. D. Santi, and thus its core 10 is substantially A-shaped and has its cross-bar portion surrounded by the induction coil 11. The two legs 16 and 17 of the A-shaped core 10 project towards the magnet orbit and terminate in pole faces at which flux is charged into the core by the magnet assembly 8. A flux shunt portion 18 of the core, remote from its legs, provides a controlled reluctance path for flux induced in the core by current flowing in the primary winding, as fully explained in the Santi patent.

The magnet assembly that cooperates with the illustrated two-legged core 10 comprises a flat ceramic magnet 9 of high coercivity that has its short dimension oriented radially to the flywheel and has its poles at its widest faces. A ferromagnetic pole shoe block 20 overlies the radially outer north pole face of the ceramic magnet to contour the periphery of the flywheel and provide a north pole N of the magnet assembly. The south pole face of the magnet flatwise overlies the medial portion of a more or less U-shaped ferromagnetic pole shoe member 21 that partially embraces the magnet. The opposite legs of the pole shoe member 21 provide a pair of south pole faces S1 and S2 that are spaced small distances in opposite circumferential directions from the north pole N.

In the following explanation it is assumed that the flywheel rotates clockwise so that, as shown, the magnet assembly moves from left to right relative to the armature 9.

As the magnet assembly moves in its orbit during a period preceding the time in the engine cycle at which a spark is to be produced, the poles S1 and N of the magnet assembly move into and then away from alignment with the pole faces on the legs 16 and 17 respectively of the armature core, thus charging into the core 10 a flux of one polarity which first builds to a peak density and then diminishes. As the flux charge of the first polarity diminishes, the pole faces N and S2 of the magnet move towards alignment with the respective core legs 16 and 17; and therefore, with continuing orbital movement of the magnet assembly, the flux charge of the first polarity tends to continue its diminution to zero and tends to be replaced by a building flux of opposite polarity.

However, at or about the time that the flux charge of first polarity begins to diminish (i.e., as the magnet poles S1 and N move beyond alignment with the core legs 16 and 17, respectively) a circuit comprising the primary winding 12 is completed. In prior magnetos such closure of the primary circuit was effected by the mechanical engagment of breaker points connected with the respective terminals of the primary winding, but in apparatus embodying the present invention the primary circuit is completed through transistor means 23, as will be fully described hereinafter. The diminishing flux of the first polarity induces an e.m.f. in the primary winding, and with the primary in a closed circuit, a current flows in the primary that tends to sustain the first polarity flux in the core. Such current continues to flow while the magnet assembly tends to charge into the core a building flux of the opposite polarity. Therefore, even as the magnet poles N and S2 are moving into alignment with the core legs 16 and 17, respectively, and are tending to charge into the core a high flux of the opposite polarity, the net flux in the core is of the first polarity. However, at or near the time when the magnet poles N and S2 align with core legs 16 and 17, the primary circuit is abruptly opened and flow of current in the primary immediately terminates. In consequence, there is an abrupt collapse of the flux field due to the current in the primary, so that the opposite-polarity magnet-charged flux predominates in the core 10. This large and extremely rapid change of flux, linked with the secondary winding 13, induces across the secondary 13 a high voltage that causes a spark to jump across the gap in the spark plug 15.

Except for the switching means (described below) that controls flow of current in a circuit comprising the primary winding, all of the apparatus described to this point is known and functions in a well known manner. As the description proceeds, it will be observed that the novel switching means of this invention does not require any alteration of this conventional structure, except that a modification of the primary winding 12 is desirable in order to obtain an adequately hot spark for adverse starting conditions, as pointed out hereinafter.

In general, the switching means of the present invention comprises the transistor means 23 by which flow of current in the primary circuit is directly controlled, a biasing coil 26 that furnishes current for biasing the transistor means on, a controlled rectifier or SCR 27 for effecting an abrupt cutoff of transistor bias, and a trigger coil 28 that cooperates with a zener diode 29 to trigger the controlled rectifier 27 into conductivity at the proper time in each engine cycle.

The transistor means 23 can be a single transistor having a fairly high gain factor at low current values and capable of handling the current in the primary circuit (several such transistors are known) or, as shown and as preferred, it can be a monolithic Darlington unit. Obviously, discrete transistors could be connected in a suitable Darlington circuit, but various integrated-circuit Darlington devices are readily available at reasonable prices and are in all respects satisfactory.

In any case the transistor means has a collector terminal C, an emitter terminal E and a base terminal B. An NPN transistor device is illustrated, but the invention lends itself equally well to embodiments incorporating a PNP transistor or transistor device, with certain modifications in associated circuitry that will be obvious to those skilled in the art in the light of the following explanation and the accompanying claims.

The terminals of the primary winding 12 are respectively connected with the collector terminal C and with the emitter terminal E of the transistor means, so that the transistor means effectively short circuits the primary winding when it is conducting but when non-conducting prevents current flow in the circuit that it defines with the primary.

The biasing coil 26 has one of its terminals connected with the base terminal B of the transistor means and has its other terminal grounded and thus connected with the emitter terminal E of the transistor means, so that the circuit comprising the biasing coil is in parallel with the circuit comprising the primary winding 12. The circuit that comprises the biasing coil 26 and the base-emitter junction of the transistor means also includes a rectifier diode (30 in FIG. 3; 36 in FIG. 4) which performs a function as explained hereinafter in effecting fast turnoff of the transistor means.

The biasing coil 26 is wound around one leg (leg 17, as shown) of the armature core, so as to be linked with the flux that is charged into the core by the magnet assembly 8, just as is the primary 12. Hence biasing current flows in the circuit comprising the biasing coil 26 and the base-emitter junction of the transistor means at the same time that flow of current in the circuit comprising the primary winding 12 is to take place.

The controlled rectifier or SCR 27 has its anode and its cathode respectively connected with the ungrounded and the grounded terminals of the biasing coil 26, so that when the SCR is conducting it short circuits the biasing coil, thereby causing the voltage at the transistor base B to drop abruptly to substantially ground potential, the voltage drop across the SCR being compensated for as described hereinafter. In this way the transistor means is turned off practically instantaneously upon triggering of the SCR.

After the transistor means is turned off, current can continue to flow in the circuit comprising the biasing coil 26 and the conducting SCR 27. Although the biasing coil 26 is wound around a leg of the armature core 10, it does not have a bight inductive coupling with either the primary winding 12 or the secondary winding 13 because, at the instant the spark is produced, the rapidly collapsing flux due to current in the primary is mainly concentrated in the flux by-pass portion 18 of the core 10, and hence relatively little of it is then coupled with the biasing coil 26. Consequently, only an insignificant part of the energy that is employed to produce the spark is diverted to the biasing coil 26.

The trigger coil 28, by which th SCR 27 is gated on at the time in the engine cycle when the spark is to be produced, is connected in a series circuit with the zener diode 29, the gate of the SCR and the cathode of the SCR; and since the cathode of the SCR is grounded, that series circuit is in shunt with the circuit comprising the SCR and the biasing coil 26. The SCR is not triggered into conductivity until voltage across the trigger coil 28 exceeds the breakdown value of the zener diode 29, and the zener diode thus prevents the time of cutoff of the transistor means 23 from varying substantially at different engine speeds and with SCRs requiring different biasing voltages.

The trigger coil 28 is wound on one leg 32 of a small L-shaped core 31 mounted inwardly adjacent to the leg 17 of the armature core that is first approached by the magnet assembly. As shown, the leg 32 of the core 31 on which the trigger coil is wound projects inwardly away from armature core leg 17, in the direction of orbital motion of the magnet assembly, while the other leg 33 of the L-shaped core is closely adjacent and parallel to the inner side of the core leg 17 and has its free end close to the magnet assembly orbit to define a small pole face.

By reason of its location and L-shaped configuration, the trigger coil core 31 cooperates with the magnet assembly 8 to define a magnetic flux path in which there is a substantially large air gap. As the magnet assembly approaches the position at which the spark is to occur, wherein the magnet poles N and S2 are respectively aligned with armature core legs 16 and 17, the magnetic flux circuit linked with the trigger coil core 31 can be traced from the north magnet pole N, across the air gap to the free end of the leg 32 of the trigger coil core, thence through the legs 32 and 33 of that core and to the south magnet pole S2. Owing to the comparatively small width and comparatively large area of the air gap between the leg 33 of the trigger coil core and the leg 17 of the magneto armature core, said armature core leg 17 is also in the flux circuit just described, to the extent that some flux passes through it, from the trigger coil core leg 33 to the south magnet pole S2.

During the interval when the transistor means 23 is conducting, a steadily increasing flux is charged through the trigger coil core by the magnet assembly 8; but at the time when the spark is to be produced, a space 34 between the poles N and S2 of the magnet assembly comes into alignment with the leg 33 of the trigger coil core so that there is a rapid decrease in density of the flux linked with the trigger coil 28. That rapidly decreasing flux induces a voltage across the trigger coil that quickly rises to the breakdown value of the zener diode 29, enabling current to flow in the gate circuit of the SCR 27.

In theory it would seem that at high engine speeds the voltage across the trigger coil 28 would rise more rapidly, and would tend to reach higher values, than at low engine speeds. If it did, the zener breakdown voltage would be attained earlier in the engine cycle at high engine speeds than at low ones, and there would be a desirable automatic advance of the spark. In practice, with the trigger coil 28 mounted as shown, spark timing is almost perfectly constant at all engine speeds, as with a mechanical breaker point device actuated by a cam on the engine crankshaft. Such fixed spark timing is of course conventional on small engines.

It is believed that the reason why the trigger coil 28 does not provide automatic spark advance in practice is, in part, that the trigger coil core 31 is magnetically saturated at the peak of the flux wave, owing to the high magnetic force of the permanent magnet 19 and notwithstanding the air gap in the flux circuit comprising the core 31. Due to hysteresis in the metal of the trigger coil core, the rate of change of flux density in the trigger coil core does not vary as much with changing engine speeds as it would with a non-saturating core, and therefore rate of rise of voltage across the trigger coil tends to be in nearly constant relation to engine speed. Also tending to offset any increase in rate of voltage rise at higher engine speeds is the time constant of the trigger coil 28 itself. In order for it to provide a voltage in excess of the zener breakdown value at all engine speeds, including cranking speeds, the trigger coil has to have a rather large number of turns. Even though it is wound with comparatively fine wire, the inductance of the trigger coil is therefore relatively high in relation to its resistance, and it therefore tends to have a fairly long time constant, which is of course independent of engine speed, and which therefore makes for a later (retarded) spark at high speeds and an earlier (advanced) spark at low speeds. Thus the time constant characteristic of the coil itself tends to offset the dynamics of its magnetic circuit in such a manner and to such an extent that the triggering impulse to the SCR is always delivered when the crankshaft is at a predetermined point in its rotation, irrespective of engine speed, just as with a fixed breaker point system.

It will be apparent that from a functional standpoint the trigger coil 28 and its core 31 could be mounted at the right-hand side of the right-hand armature core leg 16, instead of in the position shown and described. So located, however, the trigger coil would not be as well protected as when mounted between the core legs 16 and 17, and the structure as a whole would be less compact.

The zener diode 29 prevents triggering of the SCR 27 until voltage across the trigger coil 28 attains a predetermined value, and it thus ensures consistent timing of cutoff of the transistor means at all engine speeds. Since the zener diode could leak a small current to the gate of the SCR before voltage across the trigger coil reached the zener value, and a sensitive SCR might be prematurely triggered by such leakage current, a resistor 35 is connected in parallel with the SCR gate circuit to bypass such leakage currents across the SCR and prevent the SCR from being gated on until the full zener breakdown voltage has developed across the trigger coil. Specifically, one terminal of the resistor 35 is connected to the junction between the zener diode 29 and the SCR gate and its other terminal is grounded to be at the potential of the SCR cathode and the grounded side of the trigger coil.

A diode 40 is connected in series with the trigger coil 28 and the zener diode 29 to overcome another possible cause of erratic timing of SCR triggering. In the absence of the diode 40, a reverse current could flow in the circuit comprising the trigger coil 28, the resistor 35 and the zener diode 29 during the time immediately preceding the induction in the trigger coil of the forward current actually employed for SCR gating; and that reverse current would tend to persist into the time during which the useful forward voltage should be developing, thus causing postponement of the instant at which the forward voltage across the trigger coil would attain the zener breakdown value. The diode 40 of course blocks such undesired reverse current flow and permits current in the trigger coil circuit to flow only in the forward direction useful for SCR gating.

In order for the transistor means to be turned off completely and promptly upon triggering of the SCR, the potential at the base terminal B of the transistor means must be brought immediately to a potential relative to its emitter terminal E that is below the base-emitter threshold voltage of the device. However, there is some resistance through the SCR when it is conducting, and therefore the voltage drop across the SCR could be higher than the base-emitter threshold voltage of the transistor means, so that the transistor would tend to turn off slowly or incompletely. Although this might not happen in all cases, it must be borne in mind that there are variations between individual electronic components of the same type, and production efficiency requires that the apparatus be capable of operating satisfactorily without the need for individually matching components to one another. For this reason the apparatus includes a diode 30 which is connected between the ungrounded terminal of the biasing coil 26 and the base terminal B of the transistor means, and a small cutoff coil 38 that is connected across the diode 39. The cutoff coil 38 can be wound around the biasing coil 26 but in the opposite direction. In production, a single strand of wire can be used for winding the biasing coil 26 and the cutoff coil 38. The biasing coil 26 is wound first, with turns in one direction; then a tap lead is connected to the wire strand, to provide for connection of the two coils with the base terminal B and the SCR 27; and thereafter winding is continued in the reverse direction to produce the cutoff coil 38.

From FIG. 3 it will be seen that the voltage across the cutoff coil is clamped by the diode 30, which is arranged to be forwardly biased by that voltage. The biasing coil 26 is so designed that the voltage across it during the time when the transistor means is to conduct is higher than the biasing potential needed at the base terminal B by an amount equal to the voltage drop across the diode 30. When the SCR 27 is triggered, the voltage at the base terminal B is promptly dropped to the ground potential value (i.e., the potential at the emitter terminal E), inasmuch as the voltage drop across the diode 30 that is maintained by the cutoff coil 38 is equal to the voltage drop across the SCR.

At cutoff of the transistor means, the potential at the collector terminal C tends to rise briefly to a high value, owing to the inductance of the primary winding. With such high bias across the base-collector junction, most transistors pass a leakage current across that junction. However, the cutoff coil 38 and the diode 30 cooperate with one another and the conducting SCR to maintain the base of the transistor means at ground potential so that the transistor cannot turn itself back on. In effect the leakage current is shunted to ground through the cutoff coil 38 and the SCR. Although it flows in the primary winding 12, any leakage current that passes the collector-base junction is too small to have any substantial effect upon spark energy.

Some monolithic Darlington devices are made with a diode connected between the collector and emitter terminals of the device and arranged to conduct current in the direction opposite to conduction by the transistor elements. In a magneto, there is a period during which a building flux is charged into the armature core, which period precedes the interval during which current flow in the primary circuit is desired; and during that period, if current were permitted to flow through the shunting diode of a Darlington device, the building flux would induce a reverse current flow in the primary circuit that would tend to sustain itself instead of decaying and reversing, thus reducing the magnitude of the flux change responsible for the spark impulse, with a resultant low energy spark. This problem does not arise with a discrete transistor or with a Darlington circuit specially built up of discrete transistors. However, for the best combination of engine starting performance and minimum cost of the switching means, a monolithic Darlington device is preferred, and it is possible to obtain such devices that do not include a shunting diode. As compared to an individual transistor, a Darlington will usually have a higher gain at low current values, and this is desirable for providing a high energy spark at engine cranking speeds. In general, and other things being equal, the higher the low-current gain of the transistor means, the lower the coming-in speed of the magneto—coming-in speed being the lowest crankshaft speed at which a useable spark is obtained.

The circuit illustrated in FIG. 4 is suitable for use with a monolithic Darlington device that includes a shunting diode, although it can also be employed with a Darlington—as shown—that does not have such a diode, or with a discrete transistor. In FIG. 4, a diode 36 is connected in series with the primary winding 12 and the collector-emitter circuit of the transistor means. The diode 36 is arranged to pass forward current through the transistor means and hence to block flow of current in the opposite direction through any shunting diode that may be incorporated in the transistor means. The main function of the diode 36, however—performed regardless of whether or not the transistor means includes a shunting diode—is to cooperate with the cutoff coil 38 in effecting prompt turn-off of the transistor means when the SCR 27 is gated on. In the FIG. 4 circuit the cutoff coil 38 is connected across the diode 36, which again serves to clamp the voltage across that coil. The coils 26 and 38 can again be wound from a single strand of wire, but in this case the tap lead that is brought out before the cutoff coil 38 is wound is connected to the grounded side of the circuit while the ungrounded terminal of the cutoff coil 38 is connected to the junction of the emitter E with the diode 36.

If the cutoff coil 38 were not present in the circuit illustrated in FIG. 4, there would be a decreasing voltage drop across the diode 36 during the later stages of transistor turnoff, as current through the diode fell to the value at which the substantially ohmic resistance characteristics of the diode prevailed; and, owing to the substantially constant voltage drop across the conducting SCR, there would then remain a small potential difference between the base and emitter terminals of the transistor means that could permit some current to continue in circulation through the primary winding. With the cutoff coil 38 connected across the diode 36, a constant voltage drop is maintained across that diode all during the time of turnoff, which voltage drop substantially equals that across the SCR 27; hence the coil 38 positively maintains the voltage at the emitter terminal E at a fixed value above ground potential and substantially equal to the voltage at the base terminal B.

It will be evident that there will be a voltage drop across the transistor means when it is switched on, and consequently, if the primary winding 12 of FIG. 3 were satisfactory for cooperation with mechanical breaker points, the lower current that would flow in it with the solid state switching apparatus of the present invention would produce a spark that might not have a high enough energy content for fuel ignition unde adverse starting conditions. Spark energy is also very slightly reduced by current flowing in the biasing coil 26 after the SCR 27 is gated on, due to flux induced in the magneto core by such current. A further slight reduction in spark energy is due to the small amount of current that can flow in the primary winding 12 after turn-off of the transistor means, due to collector-base leakage. Notwithstanding these adverse factors, the desired high energy spark can be obtained by the simple and rather inexpensive expedient of increasing the number of turns on the primary winding by about 40% as compared with a primary intended for a mechanical breaker system. Thus, with the particular magneto system here illustrated, a 74-turn primary afforded a very satisfactory spark output with a breaker point system but with the solid state switching means of FIG. 3 the primary requires 105 turns of the same gage wire to produce an equivalent spark at starting speeds. In the circuit of FIG. 4, the diode 36 adds further resistance to the primary circuit, and therefore the primary winding would need still more turns—this being a disadvantage of the FIG. 4 arrangement as compared to FIG. 3.

In all other respects, the magneto core, the induction coil, the magnet assembly and the flywheel are identical with those used in a prior breaker point system, and it is particularly noteworth that adaptation of the magneto to the switching means of the present invention requires no change in the position of the magneto armature on the engine body and no change in the keying of the flywheel to the engine crankshaft.

From the foregoing description taken with the accompanying drawings it will be apparent that this invention provides a compact, reliable and very inexpensive breakerless switching means for flywheel magneto engine ignition systems, and that even though the solid state components of the switching means of this invention have normal variations in their performance parameters, the switching means will nevertheless afford a consistency of spark timing at all engine speeds that is comparable to a fixed-spark breaker system.

Those skilled in the art will appreciate that the invention can be embodied in forms other than as herein disclosed for purposes of illustration.

The invention is defined by the following claims:

I claim:

1. In an ignition system for a cyclically operating internal combustion engine, whereby a high voltage output is produced in timed relation to the engine cycle and which comprises a primary winding and a secondary winding, both inductively coupled with a core, and magnet means carried for orbital motion in timed relation to the engine cycle and cooperating with the core to induce a voltage across the primary winding during a period in each engine cycle that begins prior to the time when said output is to be produced, switching means for enabling current to flow in the primary winding during said period and for abruptly terminating such current flow at said time, said switching means comprising:

A. transistor means having collector, emitter and base terminals and having said collector terminal and said emitter terminal respectively connected with terminals of the primary winding so that current can flow in the primary winding and through the transistor means when the transistor means is conducting;

B. a biasing coil inductively coupled with said core and having one of its terminals connected with the base terminal of the transistor means and its other terminal connected with said emitter terminal, said biasing coil being so arranged that current induced therein by the magnet means during said period biases the transistor means on;

C. a controlled rectifier having a gate terminal and having an anode and a cathode which are respectively so connected with the terminals of the biasing coil as to short circuit the biasing coil when the controlled rectifier is conducting and thus terminate supply of biasing current to the transistor means;

D. a zener diode connected with the gate terminal of the controlled rectifier; and E. a trigger coil mounted adjacent to the orbit of the magnet means and having one of its terminals connected with the gate terminal of the controlled rectifier through said zener diode and its other terminal connected with the cathode of the controlled rectifier, said trigger coil being arranged to have a voltage induced across it by the magnet means, which voltage rises above a predetermined value at said time in the engine cycle to cause the controlled rectifier to conduct.

2. The ignition system of claim 1, further characterized by:

F. a rectifier diode connected in a series circuit that also comprises the biasing coil and the base and emitter terminals of the transistor means, to provide a voltage drop in said circuit which substantially matches the voltage drop across the controlled rectifier when the controlled rectifier is conducting and which thus ensures prompt turnoff of the transistor means in response to conduction of the controlled rectifier.

3. The ignition system of claim 2, further characterized by:

G. a cut-off coil inductively coupled with said core and connected across said rectifier diode, said cutoff coil being arranged to maintain a forward voltage across said rectifier diode to ensure complete turn-off of the transistor means when the controlled rectifier is gated on.

4. The ignition system of claim 1, further characterized by:

F. a rectifier diode through which said one terminal of the biasing coil is connected with the base terminal of the transistor means; and G. a cut-off coil inductively coupled with said core and connected across said rectifier diode, said cut-off coil being arranged to maintain a forward voltage across said rectifier diode, to thus cooperate with said diode in ensuring prompt and complete turn-off of the transsistor means when the controlled rectifier is gated on.

5. The ignition system of claim 1, further characterized by:

F. a rectifier diode through which the emitter terminal of the transistor means is connected with said other terminal of the biasing coil; and G. a cut-off coil inductively coupled with said core and connected across said rectifier diode, said cut-off coil being arranged to maintain a forward voltage across said rectifier diode, to thus cooperate with said diode in insuring prompt and complete turn-off of the transistor means when the controlled rectifier is gated on.

6. The ignition system of claim 1, further characterized by:

F. a resistor connected between the gate terminal and the cathode of the controlled rectifier.

7. The ignition system of claim 6, further characterized by:

F. a diode rectifier connected with one of said terminals of the trigger coil and arranged to permit flow of current through the trigger coil only in the direction that is effective for gating on the controlled rectifier.

8. The ignition system of claim 1, further characterized by:

said biasing coil having a substantially higher resistance than the primary winding so that only a substantially small current flows through said biasing coil when the controlled rectifier is conducting.

9. In a magneto ignition system for an internal combustion engine that has an operating cycle, said ignition system comprising magnet means carried by a part rotatable with the engine for orbital motion in timed relation to the engine cycle, a core which is fixed adjacent to the orbit of the magnet means, primary and secondary windings inductively coupled with said core, and transistor switching means having collector, emitter and base terminals and having said collector and emitter terminals respectively connected with terminals of the primary winding, control means for maintaining said transistor means biased on during an interval which terminates at the time in each engine cycle when a high voltage ignition impulse is to be induced across the secondary winding, so that a current can flow in the primary winding and through the transistor means during said interval, and for abruptly terminating biasing of the transistor means at said time, said control means comprising A. a biasing coil having terminals which are respectively connected with the base terminal and with the emitter terminal of the transistor means, said biasing coil being arranged to so cooperate with the magnet means during said interval that a current is induced in the biasing coil whereby the transistor means is biased on;

B. a controlled rectifier having a gate terminal and having an anode and a cathode that are connected with the terminals of the biasing coil to short circuit the biasing coil when the controlled rectifier is conducting;

C. a zener diode; and

D. a trigger coil having one of its terminals connected with the cathode of the controlled rectifier and having its other terminal connected with the gate terminal of the controlled rectifier through the zener diode, said trigger coil being arranged to so cooperate with the magnet means that a voltage is induced across the trigger coil which rises to a high enough value at said time in the engine cycle for current to pass the zener diode and trigger the controlled rectifier into conducting.

* * * * *